US005470301A

United States Patent [19]

Brunt, II

[11] Patent Number: 5,470,301

[45] Date of Patent: Nov. 28, 1995

[54] FOLDABLE LIFE SIZE POSTER AND METHOD FOR MAKING THE SAME

[76] Inventor: William F. Brunt, II, 631 2nd Ave. South, Nashville, Tenn. 37212

[21] Appl. No.: 180,293

[22] Filed: Jan. 12, 1994

[51] Int. Cl.[6] ..... B65H 45/12; B65H 45/28; B31F 1/08

[52] U.S. Cl. ..... 493/323; 493/324; 493/397; 493/356; 40/539

[58] Field of Search ..... 493/340, 342, 493/346, 355, 356, 372, 324, 320, 955, 959, 413, 397, 398, 399; 296/97.8; 160/84.1 C, 84.1 G; 40/539, 617

[56] References Cited

U.S. PATENT DOCUMENTS 1,737,733 12/1929 Scherotto .
3,916,838 11/1975 Swart .
4,161,833 7/1979 Wagner ..... 40/539
4,202,396 5/1980 Levy .
5,046,543 9/1991 Levy .

*Primary Examiner*—Jack W. Lavinder
*Attorney, Agent, or Firm*—Bacon & Thomas

[57] ABSTRACT

A method for fabricating a high quality life size poster of an action figure including the steps of forming a life size multi color pre-print on a web like sheet and forming a corrugated substrate including the web like sheet and having a longitudinal axis and first and second surfaces. The web like sheet is laminated or glued to a crimped portion of the substrate. A laminated figure is then die cut or otherwise formed into the silhouette of a human action figure, dinosaur or other animate or inanimate object. A plurality of fold lines transverse of the longitudinal axis are formed in the corrugated substrate which includes the web like material so that the laminated figure can be folded along the fold lines to form a compact bundle for shipping and storage and unfolded for display in its extended format.

3 Claims, 2 Drawing Sheets

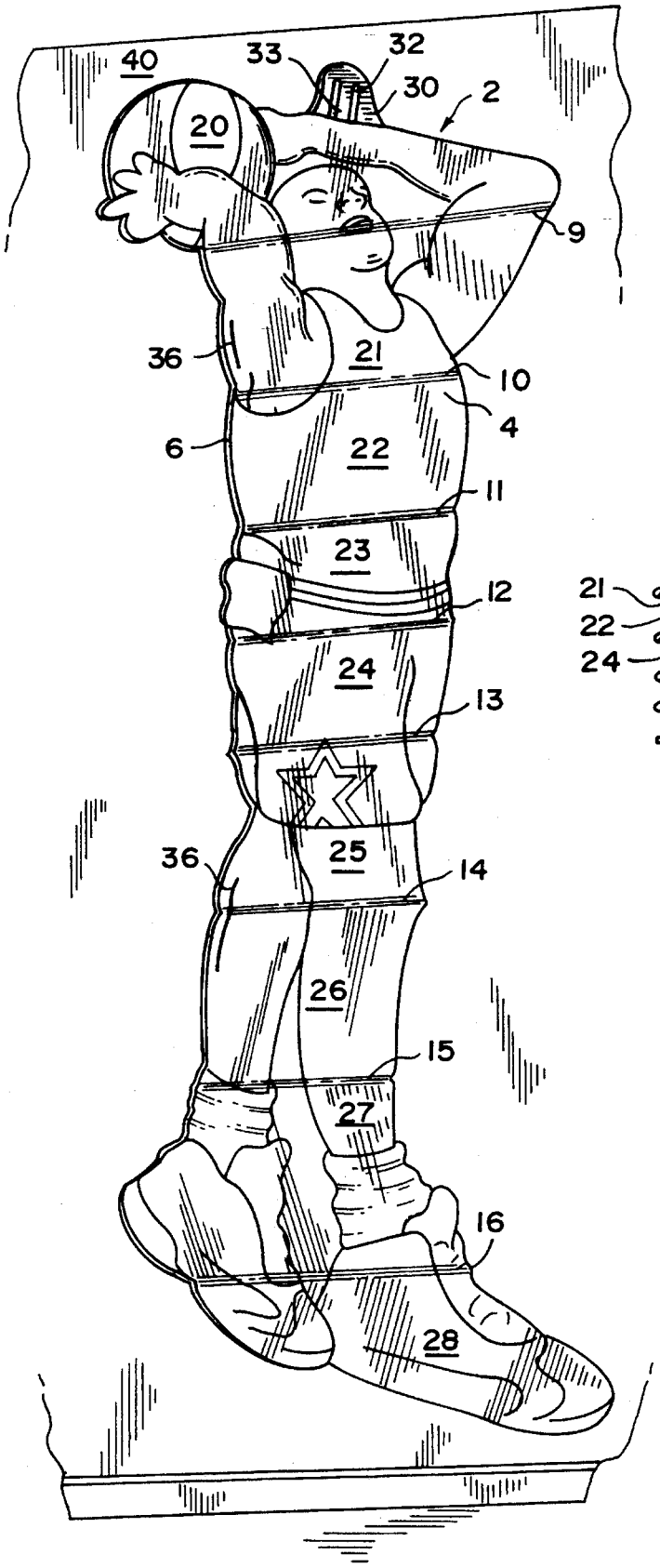
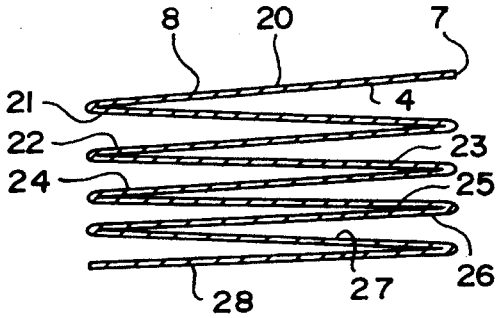
FIG. 2
FIG. 1

FOLDABLE LIFE SIZE POSTER AND METHOD FOR MAKING THE SAME

FIELD OF THE INVENTION

This invention relates to a foldable life size poster and a method for making the same, and more particularly, to a multi-color human action poster which is foldable accordion wise into a compact bundle for shipping and storage and hangable on a vertical surface such as a wall, door or support element for display in a fully extended format.

BACKGROUND FOR THE INVENTION

Foldable and board display devices have been known for many years. For example, an early U.S. patent to Scherotto, U.S. Pat. No. 1,737,733, discloses a foldable cardboard device comprised of a plurality of members of sheet material articulated to one another along parallel lines. For packing in small spaces, the display is foldable accordion wise along the lines being foldable face to face and back to back. In a display position, the members stand in slightly angular relation to one another. The device, when used, is suspended against an upright wall and to that end an upper member may be provided with an aperture for engagement with a nail or the like extending from the wall or other support.

A more recent patent, U.S. Pat. No. 3,916,838 of Swart, discloses a protective device, a foldable oblong panel which may be removably supported from a door knob. The device is designed in the simplest possible form using materials best suited to the elimination of costly materials and includes a fold-up feature to reduce shipping size to a minimum. In addition, the device includes a decorative appearance such as a printed graphic design on a fold-up cardboard device and a die cut opening at the top for suspension from a doorknob.

Finally, a U.S. patent of Levy, U.S. Pat. No. 5,046,543, discloses a motor vehicle sunshield and poster for displaying a poster-like message through the windshield of a motor vehicle. The sunshield is foldable accordion style and is made manually stretchable by a person for a public display of the message outdoors by providing the sunshield with lateral handles with which the sunshield may be engaged and held up, such as by several fingers of each hand.

It now appears that there may be a significant demand for high quality life size posters of human action figures such as professional athletes, i.e., baseball, basketball, football, hockey, soccer, tennis and other players, as well as entertainers. There may also be a demand for other large or oversize posters of action figures such as dinosaurs, large animals, etc. Such posters should be as realistic as possible, in full color and approximate the star's actual size, silhouette and appearance insofar as possible. And because of the large size of such posters, they should be foldable in accordion fashion into a small bundle for storage or shipping. Such posters should also be relatively durable, light in weight and of moderate or low cost. In addition, it is desirable that such posters can be readily displayed in a fully extended form by hanging on a wall without marring the head of the action figure. It is also desirable such posters provide a three-dimensional appearance.

It has now been found that a foldable poster of a life size human action figure or the like in accordance with the present invention may be produced by the method disclosed herein and will have the aforesaid desirable features.

A foldable poster depicting a life size human action figure or the like in accordance with the present invention and a method for making the same will now be described.

BRIEF SUMMARY OF THE INVENTION

In essence, the present invention contemplates a foldable life size poster of a human action figure or the like. The poster includes a life size multi-color pre-print on a web like sheet and a corrugated substrate having a longitudinal axis and first and second surfaces. The pre-print forms the first or top surface of the corrugated substrate which also includes a crimped center portion and backing sheet. The web like sheet is laminated or glued to the crimped portion of the substrate. The poster also includes a plurality of parallel and alternating fold lines transverse to the longitudinal axis so that the poster is foldable accordion like along the fold lines to form a relatively small bundle or package for shipping or storage. The corrugated substrate with the web like sheet laminated thereto is die cut to the shape or silhouette of a human action figure or the like when in its open or extended format and includes means which are separate from or above the action figure for hanging the poster on a vertical surface or support element for display in an essentially fully extended format.

The invention also contemplates a method for fabricating a high quality life size poster of an action figure or the like. In essence, the method includes the steps of forming a life size multi-color pre-print on a web like sheet and forming a corrugated substrate including the web like sheet and having a longitudinal axis and first and second surfaces. The web like sheet is laminated or glued to a crimped portion of the substrate. A laminated figure is then die cut or otherwise formed into the silhouette of a human action figure, dinosaur or other animate or inanimate object. A plurality of accordion like pleats or compression scores transverse of the longitudinal axis are formed in the corrugated substrate which includes the web like sheet. The transverse fold line like pleats or compression scores are preferably formed along essentially horizontal axes which are perpendicular to the longitudinal axis of the poster when in its extended format. A mounting support appendage extends above the top of the life size figure for hanging the poster on a vertical surface such as a wall, door, support element or the like. In a preferred embodiment of the invention, a mounting tab appendage is also formed at the bottom of the poster for fixing that portion of the poster to the vertical surface or support element so that the poster remains fully extended. The poster is then folded along the accordion pleats or compression scores to form a compact bundle for shipping and storage and unfolded for display in its extended format.

BRIEF DESCRIPTION OF THE DRAWINGS

FIG. 1 is a perspective view of a poster in accordance with the present invention shown in aft essentially fully extended format;

FIG. 2 is a side elevational view of the poster shown in FIG. 1, but in a partially folded view illustrating the accordion like or Z folds;

DESCRIPTION OF THE PREFERRED EMBODIMENT OF THE INVENTION

Figure 3:
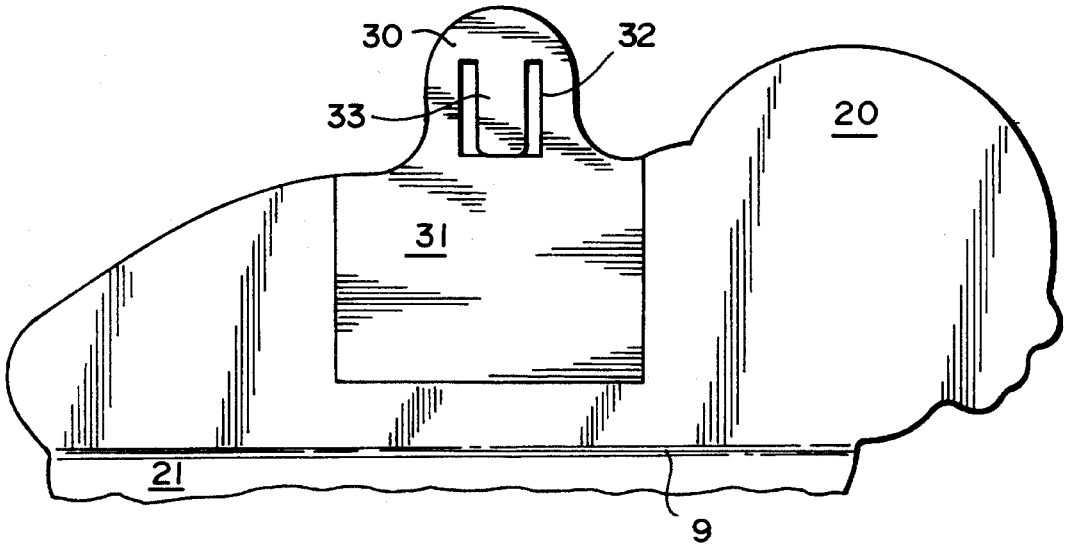
FIG. 3 is a rear view of a portion of the poster shown in FIG. 1, but illustrating a preferred form of the support means or appendage which extends above the action figure of the poster; and, FIG. 4 is a cross sectional view which shows the support means in accordance with a second embodiment of the invention.

As illustrated in FIG. 1, a poster 2 in accordance with a preferred embodiment of the invention includes a life size multi-color pre-print on a web like sheet 4 of relatively high quality paper such as 42 pound bleached white clay coated stock which is available from Federal, a corporation of Augusta, Ga. and identified as "clay coated bleach". This multi-color pre-print may, for example, be of a professional athlete such as a basketball, baseball, football, hockey or soccer player. The pre-print might also be of an entertainer, celebrity, cartoon character, dinosaur, large animal or other animate or inanimate object which would be suitable for a large scale display.

The poster 2 also includes a substram 6 of bleached white corrugated paper or the like. In the practice of the invention, it has been found that life size posters are preferably made of a corrugated paper with an E-flute configuration. E-flute is, from a practical point of view, the thinnest configuration which provides minimal structural support for the large poster and which can be embossed. Such papers are suitable for large size posters and at the same time, are capable of being folded in a manner to be described hereinafter into a relatively small bundle for packing, shipping and/or storage and die cutting and/or embossment.

The substrate 6 has a relatively long longitudinal axis such as along the height of a human action figure. For example, a poster of a professional basketball player reaching for a rebound could extend to about 8 feet or more which would correspond to the longitudinal axis of the poster 2. Therefore, it is desirable to form a multicolor pre-print of such figures on a roll of paper, i.e., the web like sheet 4 and to glue or laminate the sheet 4 onto a crimped center section 7 to form substrate 6. The substrate 6 also includes a backing sheet 8 which may also be of a bleached paper and of the same weight as sheet 4. The backing sheet 8 may also be pre-printed as for example to show the back or rear view of a human action figure. It should be recognized, however, that pre-printing the backing sheet would add to the cost of the poster and could present alignment problems.

The poster 2 also includes a plurality of preferably lateral fold lines 9–16. The lateral fold lines 9–16 are transverse of the longitudinal axis and preferably parallel to one another. Such fold lines are, for example, horizontal in a preferred embodiment of the invention when the poster 2 is displayed in an extended format on a vertical surface. In the preferred embodiment of the invention, the parallel fold lines divide the poster into a plurality of panels 20–28 which may be essentially rectangular in shape except for the outer edges which conform to a portion of the silhouette of the action figure. The panels are alternatively biased clockwise and counterclockwise by the poster material at or relative to the fold lines 9–16, as illustrated more clearly in FIG. 2. For this reason it is also desirable to have the panels of essentially the same height.

The method for making a high quality life size poster of a human action figure or the like in accordance with the present invention includes the step of forming a life size multi-color pre-print on a web like sheet. The web like sheet or roll of bleached white clay coated paper is printed by means of flexography. Flexography is a rotary letterpress printing process which uses photopolymer flexo printing plates and a simplified ink distribution system. Such systems include a flexo Anilox roll having between 30,000 and 300,000 cells/inch$^2$ (4500–45,000/cm.$^2$). The ink distribution system operates by flooding the surface of the Anilox roll with ink to thereby fill the cells with ink. A reverse angle doctor blade shaves the surplus ink off of the roll. Further details of the process are described in more detail in *McGraw Hill Encyclopedia of Science and Technology,* 6th Edition, 1987, volume 14, pages 301–301 which is incorporated herein by reference. The flexographic process was selected for the ability to print large sizes. The flexographic process is also preferred because of its accuracy, versatility, speed, economy and print quality.

Flexography is used in a preferred embodiment of the invention so that an image of a life size human action figure such as a professional basketball player with his arms extended overhead and with a basketball in his hands can be printed on a single sheet of paper. A human action figure as described may, for example, have a length of 96 inches or greater. Accordingly, it is not feasible to use a conventional offset printing method of about 80 inch maximum capacity.

The second step in making a poster in accordance with the present invention is to form a corrugated substrate including the multi-color pre-print which forms a first or top surface of the substrate. In one preferred embodiment of the invention, the web like sheet is a roll of 42# bleached white clay coated paper which is glued or laminated to a crimped center and backing sheet simultaneously. The crimped center is preferably an E-flute which provides sufficient structural stability and yet can be readily folded into a compact package for shipping, storage die cutting and embossing.

Figure 4:
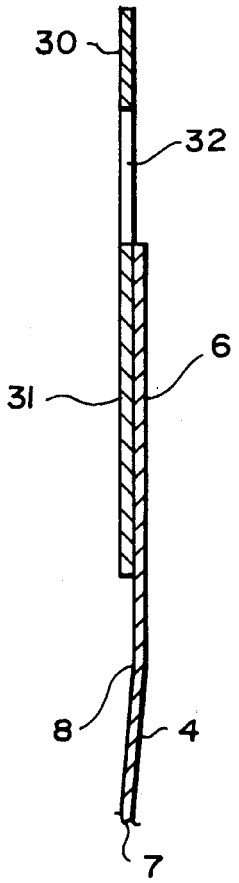

After forming a corrugated substrate with a multi-color pre-print as the top surface, the substrate is die cut to form the silhouette or outline of the action figure. During this step a mounting support appendage 30 and/or mounting tab appendage is also die cut and may form an integral part with the poster. For example, the mounting support extends above the action figure so that there is no imperfection in the pre-printed image. The mounting support may also include a U-shaped cut out 32 having an inner tab 33 which may fold back over and hook against the back of the poster when the poster is hung on a vertical surface 40 such as a wall, door, support or the like. FIG. 3 illustrates a preferred embodiment of the invention wherein the mounting support 30 is an integrated element of the corrugated substrate. In FIG. 4, the appendage is shown as a separate element which is glued to the back of the poster. This mounting suppert appendage 30 may also be used to engage a support element or the like in the event that the poster is to be displayed as a stand alone unit.

A second tab 35 may also be formed at the bottom of the poster for fastening the bottom of the poster to a vertical surface or support element. The second tab 35 may also be used to maintain the poster in a fully extended format. In the preferred embodiment of the invention, the second tab appendage 35 is an integrated element of the human action figure.

After or during die cutting the substrate, a plurality of lateral fold lines are formed in a conventional manner. For example, a pair of compression score dies, one male and one female can be used to form a Z-fold, i.e., a plurality of preferably parallel fold lines that divide the poster into a plurality of generally rectangular panels of about the same height so that the poster can be alternately folded accordion like into a small package as shown in FIG. 2.

In accordance with a preferred embodiment of the invention, the surface including the multi-color pre-print is embossed to form indentations 36 as for example to more clearly define an athlete's musculature and to provide a three-dimensional effect.

While the invention has been described in connection with its preferred embodiments, it should be understood that changes and modifications may be made without departing from the scope of the appended claims.

What is claimed is:

1. A method for making a life size poster of an action figure comprising the steps of:

(a) forming a life size multi-color pre-print on a web like sheet;

(b) forming a corrugated substrate including said multi-color pre-print having a longitudinally extending axis with the web like sheet forming one surface thereof;

(c) die cutting the corrugated sheet into the silhouette of a human action figure or the like; and forming a mounting support which extends from the life size figure for displaying the figure in an essentially fully extended format;

(d) providing a plurality of lateral fold lines transverse of the longitudinal axis;

(e) folding the life size poster along the fold lines to thereby provide a compact package; and (f) embossing the surface of the corrugated substrate with the web like sheet thereon to further define a musculature of the human action figure and to give the poster a three-dimensional effect.

2. A method for making a life size poster of an action figure in accordance with claim 1 in which the mounting support is an extension of the corrugated substrate and extends upwardly therefrom, above the top of the human figure or the like.

3. A method for making a life size poster of an action figure in accordance with claim 2 in which the multi-color pre-print is formed by a flexographic process.

* * * * *